US009599108B2

(12) United States Patent
Khanzode et al.

(10) Patent No.: US 9,599,108 B2
(45) Date of Patent: Mar. 21, 2017

(54) TWO ROTOR VANE PUMP

(71) Applicant: GM Global Technology Operations LLC, Detroit, MI (US)

(72) Inventors: Tushar P. Khanzode, Nagpur (IN); Richard F. Olenzek, Farmington Hills, MI (US); Terrence D. Hogan, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 105 days.

(21) Appl. No.: 14/751,472

(22) Filed: Jun. 26, 2015

(65) Prior Publication Data

US 2016/0377077 A1 Dec. 29, 2016

(51) Int. Cl.

| | |
|---|---|
| ***F01C 1/00*** | (2006.01) |
| ***F04C 14/02*** | (2006.01) |
| ***F04C 2/344*** | (2006.01) |
| ***F04C 11/00*** | (2006.01) |
| ***F04C 15/00*** | (2006.01) |

(52) U.S. Cl.

CPC ..... *F04C 14/02* (2013.01); *F04C 2/3448* (2013.01); *F04C 11/001* (2013.01); *F04C 15/0073* (2013.01)

(58) Field of Classification Search

CPC ..... F04C 2/102; F04C 11/006; F04C 14/02; F04C 14/06; F04C 15/0061; F04C 2/3448; F04C 11/001; F04C 15/0073

See application file for complete search history.

(56) References Cited

U.S. PATENT DOCUMENTS

| | | | | |
|---|---|---|---|---|
| 5,213,491 | A * | 5/1993 | Fujiwara | F04C 11/001 418/133 |
| 5,261,796 | A * | 11/1993 | Niemiec | F04B 1/20 417/203 |
| 6,579,070 | B1 * | 6/2003 | Birkenmaier | F01C 21/0863 417/216 |
| 2002/0114703 | A1 * | 8/2002 | Bodzak | F04C 2/18 417/62 |
| 2006/0037830 | A1 * | 2/2006 | Sowul | F16D 25/061 192/69.9 |
| 2006/0213477 | A1 * | 9/2006 | Schulz-Andres | F04C 11/001 123/196 R |
| 2008/0286123 | A1 * | 11/2008 | Yoshinami | F04C 2/102 417/118 |
| 2011/0129359 | A1 * | 6/2011 | Hawkins | F04C 2/14 417/53 |

(Continued)

*Primary Examiner* — Jesse Bogue

(57) ABSTRACT

A vane pump includes a first cam ring and a second cam ring, a first rotor positioned in the first cam ring and a second rotor positioned in the second cam ring, and a shaft. The first rotor is engaged with the shaft so that the first rotor rotates relative to the first cam ring about an axis extending through the shaft, and the second rotor selectively engages with the shaft so that the second rotor selectively rotates relative to the second cam ring about the axis. A piston positioned in the shaft translates within the shaft between a first position and a second position. When in the first position, the shaft engages with the second rotor so that the second rotor rotates relative to the second cam ring about the axis, and when in the second position, the shaft disengages with the second rotor so that the second rotor does not rotate relative to the second cam ring.

19 Claims, 4 Drawing Sheets

(56) References Cited

U.S. PATENT DOCUMENTS

| | | | | |
|---|---|---|---|---|
| 2015/0285371 | A1* | 10/2015 | Schultz | F04B 1/00 60/459 |
| 2015/0361978 | A1* | 12/2015 | Cho | F04C 15/0076 418/83 |
| 2016/0281712 | A1* | 9/2016 | Muizelaar | F04C 2/102 |

* cited by examiner

TWO ROTOR VANE PUMP

FIELD

The present disclosure relates to a pump for motor vehicles. More specifically, the present disclosure relates to a two rotor vane pump.

BACKGROUND

The statements in this section merely provide background information related to the present disclosure and may or may not constitute prior art.

Many modern motor vehicle automatic continuously variable transmissions (CVT) utilize controlled hydraulic fluid (for example, transmission oil) to actuate CVT belt and pulleys (or chain and pulleys) to achieve a desired ratio in downsized turbo boosted engines to optimize fuel economy. The control of such hydraulic fluid is achieved by a valve body that directs hydraulic fluid flow to pulley pistons as well as other clutch and brake actuators. The valve body is supplied with pressurized hydraulic fluid from, typically, a gear or vane pump, which is driven by the engine output shaft or the transmission input shaft.

For example, in some configurations, a fixed displacement pump provides fluid flow proportional to engine speed. The pump is often sized to meet hydraulic pressure and volume demands of the transmission at low speed idle engine conditions. Larger diameter higher displacement pumps that meet hydraulic demands of the transmission near engine idle speed often contribute to undesirable transmission spin losses and decrease efficiency of the transmission. A large pump will provide much greater oil flow than what is consumed by the transmission at higher engine speeds, with higher pump power consumption leading to loss in overall transmission efficiency.

Accordingly, the present invention is directed to a pump that improves transmission efficiency while meeting hydraulic demands of the transmission.

SUMMARY

A vane pump includes a first cam ring and a second cam ring, a first rotor positioned in the first cam ring and a second rotor positioned in the second cam ring, and a shaft. The first rotor is engaged with the shaft so that the first rotor rotates relative to the first cam ring about an axis extending through the shaft, and the second rotor selectively engages with the shaft so that the second rotor selectively rotates relative to the second cam ring about the axis. A piston positioned in the shaft translates within the shaft between a first positon and a second position. When in the first position, the shaft engages with the second rotor so that the second rotor rotates relative to the second cam ring about the axis, and when in the second position, the shaft disengages with the second rotor so that the second rotor does not rotate relative to the second cam ring.

Further features, advantages, and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way. The components in the figures are not necessarily to scale, emphasis instead being placed upon illustrating the principles of the invention. Moreover, in the figures, like reference numerals designate corresponding parts throughout the views. In the drawings.

DETAILED DESCRIPTION

The following description is merely exemplary in nature and is not intended to limit the present disclosure, application, or uses.

Figure 1:
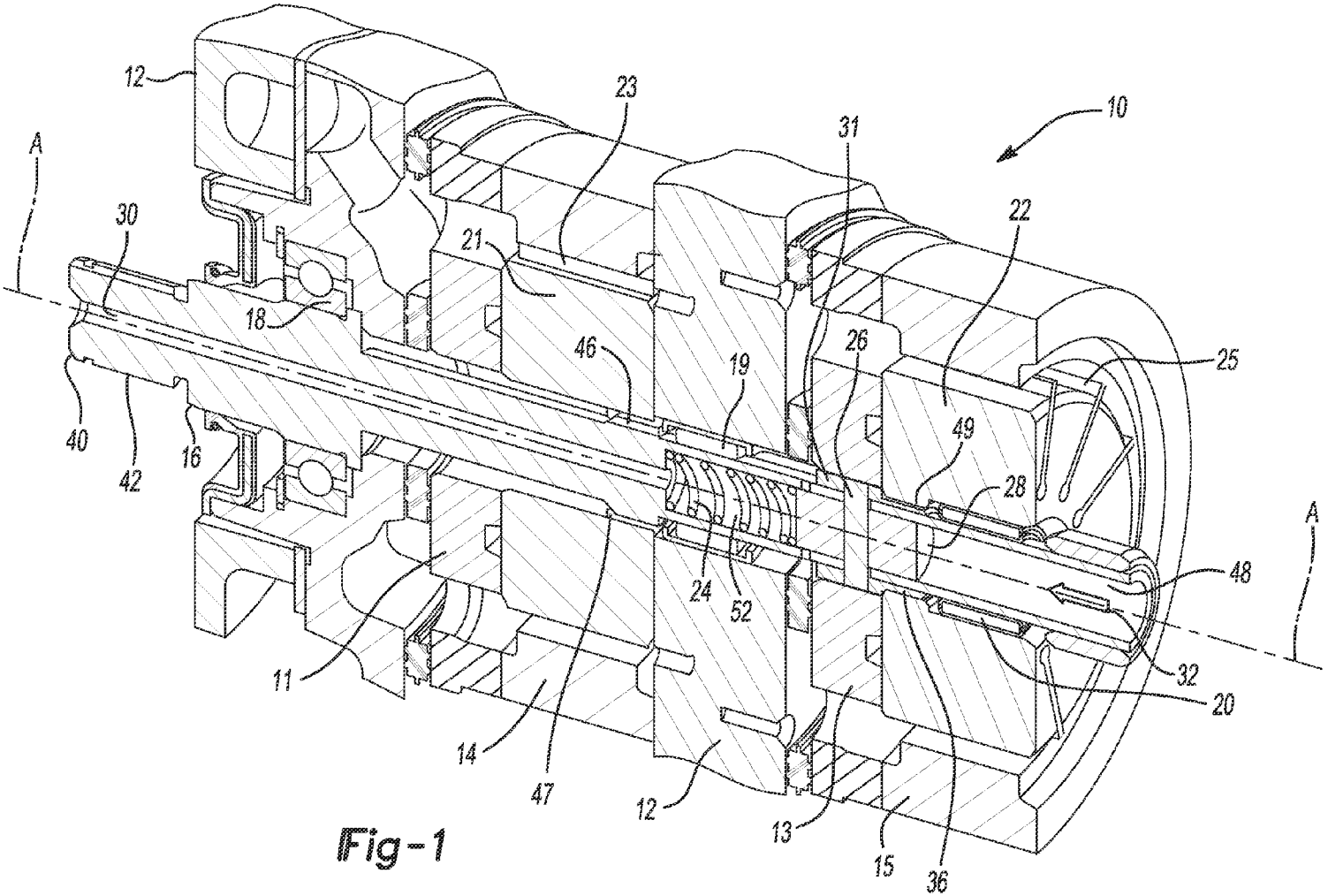
FIG. 1 is a perspective cross-sectional view of a rotor pump in accordance with the principles of the present invention.

Referring now to the drawings, a two rotor vane pump embodying the principles of the present invention is illustrated in FIG. 1 and designated at 10. The rotor pump 10 includes a housing 12 with a first cam ring 14 and a second cam ring 15. The first cam ring is positioned between a first pressure plate 11 and a second pressure plate 12, and the second cam ring 15 is adjacent to the second pressure plate 12. A first rotor 21 is positioned within the first cam ring 14, and a second rotor 22 is positioned in the second cam ring 15. A shaft 16 is positioned within the first and second cam rings 14 and 15 and the housing 12. The shaft 16 is supported by a bearing 18 and a roller 19 to enable the shaft 16 to rotate within the first and second cam rings 14 and 15 and the housing 12 about an axis A-A. The shaft 16 is further supported by a roller 20 that allows the shaft 16 to rotate relative to the second rotor 22 when the second rotor 22 is stationary.

Figure 3:
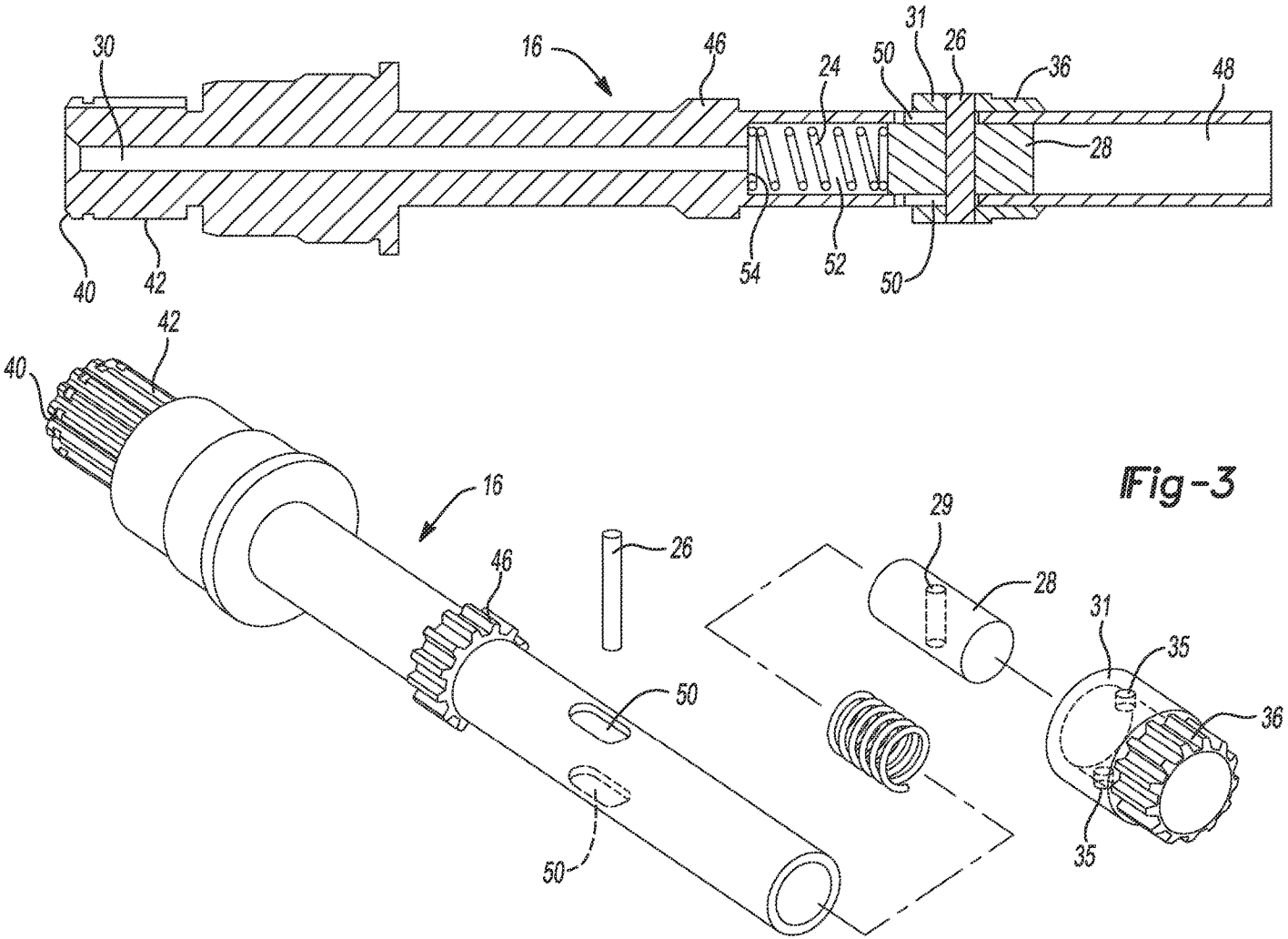
FIG. 3 are close-up views of certain components of the rotor pump shown in FIG. 1.

The first rotor 21 includes a set of vanes 23. The vanes of the set of vanes 23 are spaced apart and positioned about the outer periphery of the first rotor 21. The second rotor 22 includes a set of vanes 25. The vanes of the set of vanes 25 are spaced apart and positioned about the outer periphery of the second rotor 22. Referring further to FIG. 3, the shaft 16 includes a set of teeth 46 positioned around the midsection of the shaft 16. The set of teeth 46 engage with a set of teeth 47 located in the interior of the first rotor 21. As such, as the shaft 16 is in continuous engagement with the first rotor 21 so that rotation of the shaft 16 results in a corresponding rotation of the first rotor 21.

A dog clutch 31 is positioned about the shaft 16. A piston 28 is positioned in a bore 48 of the shaft 16. The piston 28 is coupled to the shaft 16 with a pin 26 that extends through a hole 29 of the piston 28 and diametrically positioned holes 35 of the dog clutch 31. The pin 26 engages with a pair of diametrically positioned slots 50 in the shaft 16. Accordingly, the piston 28 is able to slide translationally back and forth within the bore 48 to the extent that the ends of the pin 26 are able to slide along the slots 50. A spring 24 is positioned in a region 52 between the piston 28 and a face 54. Hence, as the piston 28 slides towards the face 54, the spring 24 is compressed between the piston 28 and the face 54. A passageway 30 extends from the end 40 along the shaft 16 to the region 52. As such, the passageway 30 enables the region 52 to communicate with the exterior of the shaft 30. The end 40 includes a set of teeth 41 that engages with, for example, a chain that is also engaged with an output shaft of an engine or input shaft of a transmission such that rotation of the engine output shaft or the transmission input shaft drives the pump 10.

The dog clutch 31 includes a set of teeth 36 that, depending on the position of the dog clutch 31 relative to the shaft 16, selectively engages with a set of teeth 49 located in the interior region of the cam ring 22. Hence, rotation of the shaft 16 results in the rotation of the second rotor 22 and consequently the rotation of the vanes 25 when the teeth 36 of the dog clutch 31 are engaged with the teeth 49 of the cam ring 22. When the teeth 36 are unengaged from the teeth 49, the shaft 16 is unengaged from the second rotor 22 such that rotation of the shaft 16 does not produce direct rotation of the second rotor 22.

Engagement of the dog clutch 31 with the second rotor 22 is determined by the position of dog clutch 31 relative to the second rotor 22. Specifically, the dog clutch 31 is in a first, or engaged, position when its teeth 36 are engaged with the teeth 49 of the second rotor 22, and the dog clutch 31 is in a second, or unengaged, position when its teeth 36 are unengaged with the teeth 49 of the second rotor 22. Accordingly, when the dog clutch 31, and hence the piston 28 is in the first position, both the first rotor 21 and the second rotor 22 rotate along with the rotation of the shaft 16 so that the two vane rotor pump 10 operates, for example, as a high pressure pump. And when the dog clutch 31, and hence the piston 28 is in the second position, only the first rotor 21 rotates along with the rotation of the shaft 16 so that the two vane rotor pump 10 operates, for example, as a low pressure pump. Note that a synchronizer can be employed in place of the dog clutch 31.

Figure 2A:
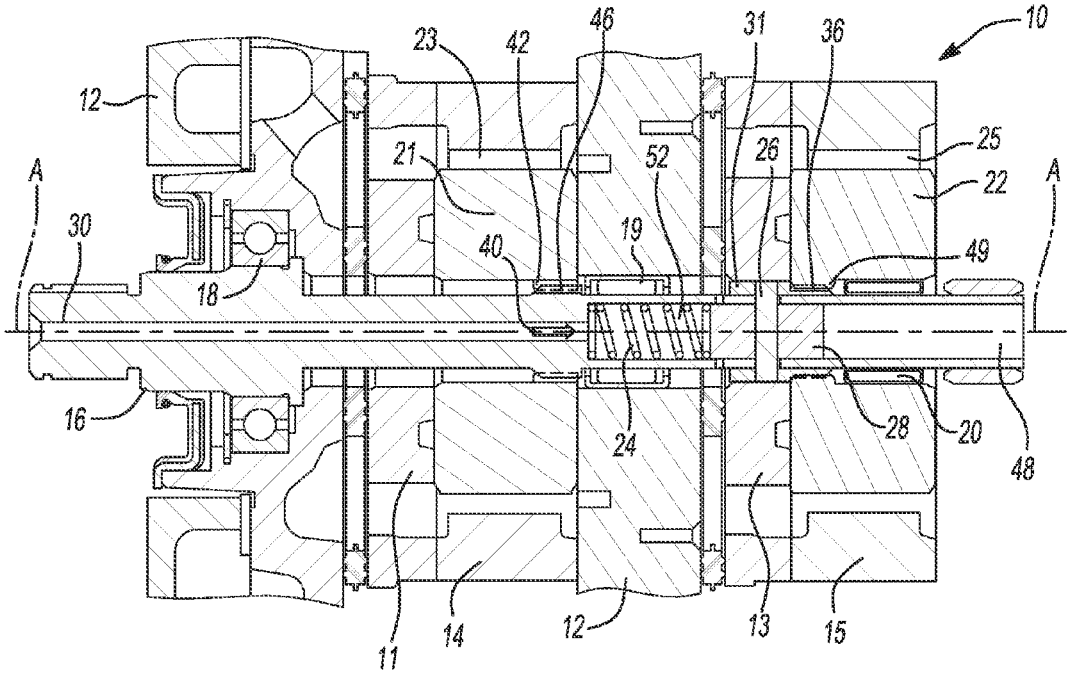
FIG. 2A is a side cross-sectional view of the rotor pump shown in FIG. 1 when the rotor pump is in an engaged condition.
Figure 2B:
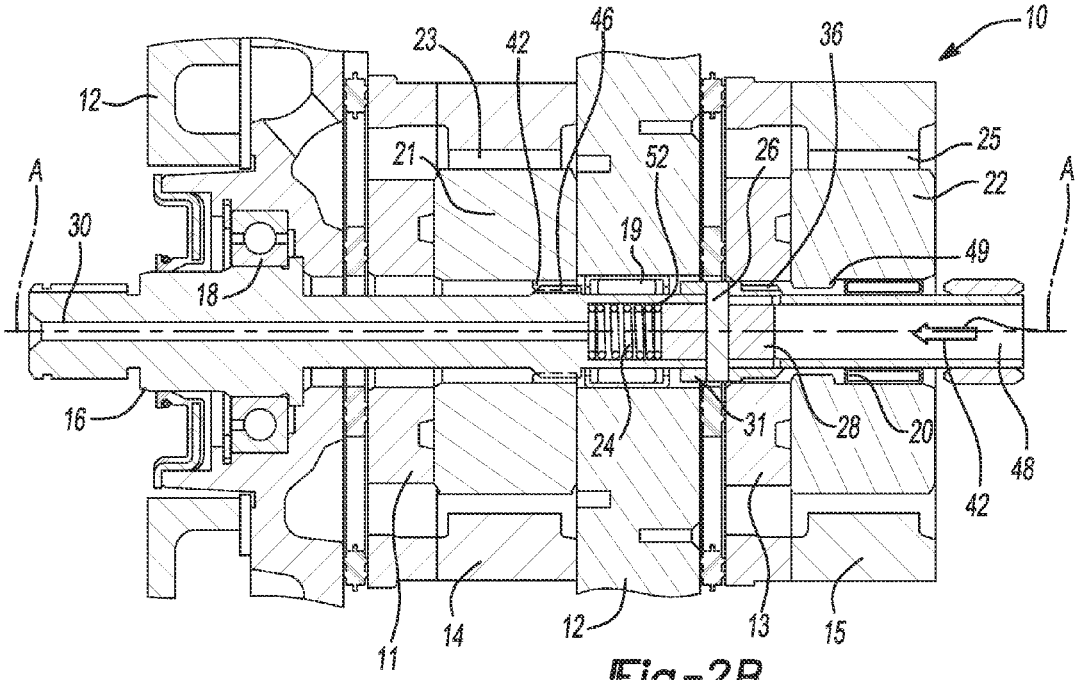
FIG. 2B is a side cross-sectional view of the rotor pump shown in FIG. 1 when the rotor pump is an a disengaged condition.

Turning now to FIGS. 2A and 2B, there is shown the two vane rotor pump 10 in use. Specifically, when the combined force on the piston 28 produced by the hydraulic pressure in the passageway 30 and the biasing force of the spring 24 exceeds the counterforce on the piston 28 produced by the hydraulic pressure in the bore 48, the piston 28, and hence the dog clutch 31, moves to the first engaged position as indicated by the arrow 40. And when the counterforce on the piston 28 produced by the hydraulic pressure in the bore 48 exceeds the combined force on the piston 28 produced by the hydraulic pressure in the passageway 30 and the biasing force of the spring 24, the piston 28, and hence the dog clutch 31, moves to the second unengaged position as indicated by the arrow 32.

Figure 4:
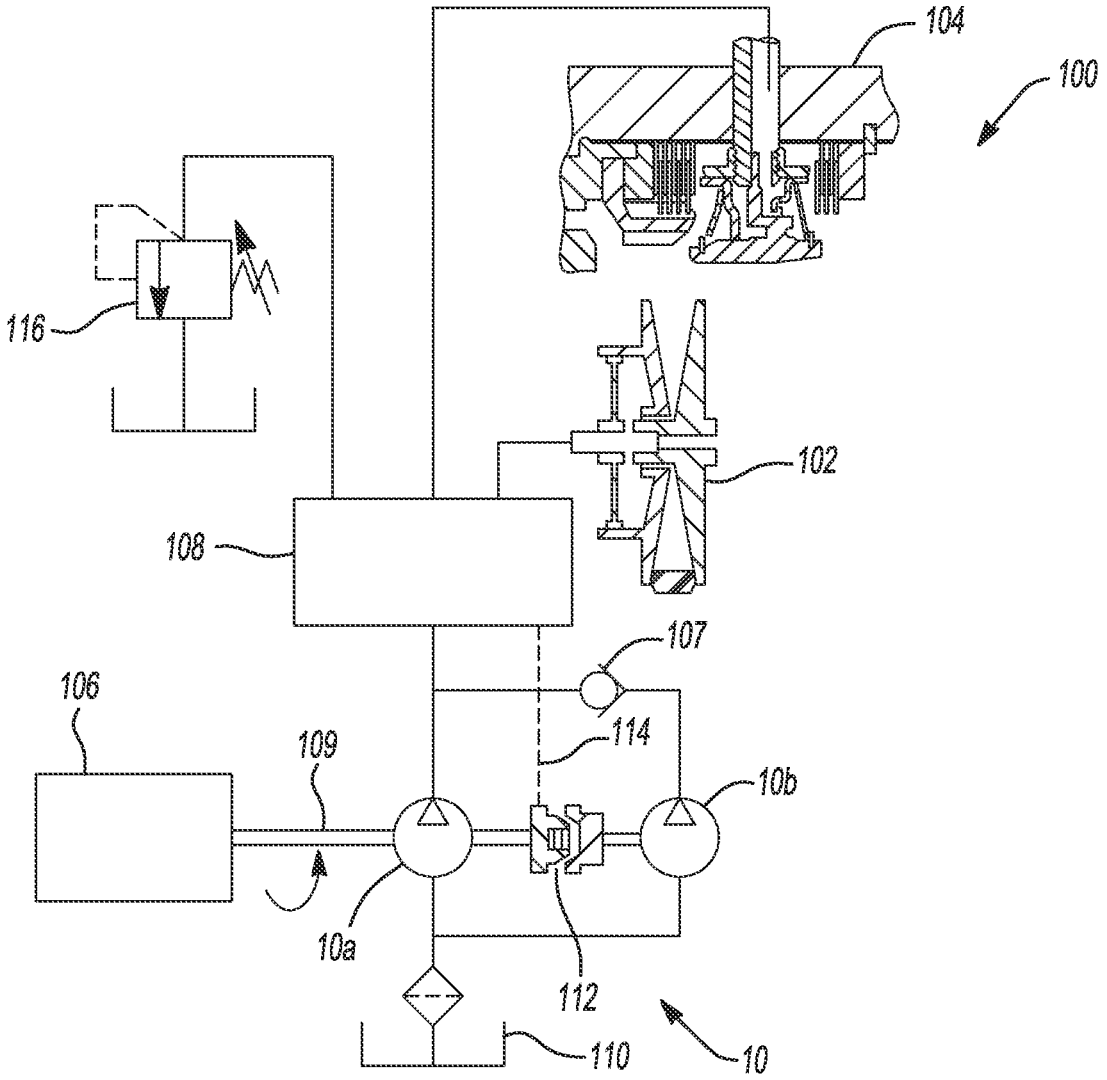
FIG. 4 is a diagrammatic view of a hydraulic circuit employing the rotor pump shown in FIG. 1 in accordance with the principles of the present invention.

Referring now to FIG. 4, there is shown a hydraulic circuit 100 that employs the vane rotor pump 10 in accordance with the principles of the present invention. In the circuit 100, the vane rotor pump 10 is identified by a pair of components 10*a* and 10*b*. The component 10*a* employs the first rotor 21 and the component 10*b* employs the second rotor 22. The hydraulic circuit 100 includes a prime mover 106, such as, for example, a motor, coupled to the pump 10 with a shaft 109. In addition to the pump 10, the hydraulic circuit 100 further includes a controller 108 coupled to a pressure relief valve 116, a clutch pack 104, a continuously variable transmission (CVT) pulley 102, and a hydraulic fluid reservoir or sump 110. The two components 10*a* and 10*b* are selectively coupled together with a synchronizer 112. Alternatively, the two components 10*a* and 10*b* can be selectively coupled together with the dog clutch 31 as described previously. The circuit 100 can operate as a single circuit or two independent circuits.

When the hydraulic circuit 100 is in use, the prime mover 106 rotates the first rotor 21 of the first component 10*a* at a desired speed so that the pump 10 supplies low pressure hydraulic fluid from the reservoir or sump 110 through the transmission controller 108 to the clutch pack 104. When high pressure hydraulic fluid is desired to operate, for example, the CVT pulley 102, the transmission controller 108 transmits a signal along a line 114 to the synchronizer 112 to couple the two components 10*a* and 10*b* together so that the second rotor 22 rotates along with the first rotor 21. Accordingly, additional hydraulic fluid is pumped from the component 10*b* through a check valve 107 so that the components 10*a* and 10*b* operate together as a high pressure pump for supplying high pressure hydraulic fluid to the CVT pulley 102. If the pressure in the circuit 100 rises to a predetermined maximum pressure, the pressure relief valve 116 releases enough hydraulic fluid to prevent over-pressurization the circuit 100.

The description of the invention is merely exemplary in nature and variations that do not depart from the gist of the invention are intended to be within the scope of the invention. Such variations are not to be regarded as a departure from the spirit and scope of the invention.

What is claimed is:

1. A vane pump comprising:

a first cam ring and a second cam ring;

a first rotor positioned in the first cam ring and a second rotor positioned in the second cam ring;

a shaft, the first rotor being engaged with the shaft so that the first rotor rotates relative to the first cam ring about an axis extending through the shaft, and the second rotor being selectively engaged with the shaft so that the second rotor selectively rotates relative to the second cam ring about the axis;

a piston positioned in the shaft, the piston configured to translate within the shaft between a first positon and a second position, wherein in the first position, the shaft engages with the second rotor so that the second rotor rotates relative to the second cam ring about the axis, and in the second position, the shaft disengages with the second rotor so that the second rotor does not rotate relative to the second cam ring; further comprising a dog clutch positioned about the shaft, the shaft engaging and disengaging with the second rotor with the dog clutch.

2. The vane pump of claim 1 wherein the shaft includes a pair of slots and the piston includes a hole through which a pin extends and engages with the slots, the pin sliding back and forth in the slot as the dog clutch translates between the first position and the second position.

3. The vane pump of claim 1 further comprising a spring positioned within the shaft and between the piston and an interior face within the shaft.

4. The vane pump of claim 3 wherein the first position results when the force of the spring pushes the piston away from the interior face.

5. The vane pump of claim 2 wherein the second position results when the movement of the piston compresses the spring between the interior surface and the piston.

6. The vane pump of claim 1 wherein the first rotor includes a first plurality of vanes, the first plurality of vanes being space apart and positioned about the outer surface of the first rotor between the first rotor and the first cam ring.

7. The vane pump of claim 6 wherein the second rotor includes a second plurality of vanes, the second plurality of vanes being space apart and positioned about the outer surface of the second rotor between the second rotor and the second cam ring.

8. The vane pump of claim 1 further comprising a housing, the first and second cam rings being positioned in the housing.

9. The vane pump of claim 1 further comprising a first pressure plate positioned between the first rotor and the housing.

10. The vane pump of claim 1 further comprising a second pressure plate positioned between the second rotor and the housing.

11. A method of operating a vane pump comprising:

rotating a shaft that is engaged to a first rotor positioned in a first cam ring so that the first rotor rotates relative to the first cam ring about an axis extending through the shaft; and sliding a dog clutch positioned about the shaft such that the dog clutch engages with a second rotor positioned in a second cam ring, the dog clutch being rotationally engaged with the shaft so that the second rotor rotates relative to the second cam ring as the shaft rotates about its axis.

12. The method of claim 1 wherein the shaft includes a pair of slots and the piston includes a hole through which a pin extends and engages with the slots, the pin sliding back and forth in the slot as the dog clutch translates between the engaged position and the disengaged position.

13. The method of claim 1 further comprising a spring positioned within the shaft and between the piston and an interior face within the shaft.

14. The method of claim 13 wherein the engaged position results when the force of the spring pushes the piston away from the interior face.

15. The method claim 14 wherein the disengaged position results when the movement of the piston compresses the spring between the interior surface and the piston.

16. The method of claim 12 wherein the first rotor includes a first plurality of vanes, the first plurality of vanes being space apart and positioned about the outer surface of the first rotor between the first rotor and the first cam ring.

17. The method of claim 16 wherein the second rotor includes a second plurality of vanes, the second plurality of vanes being space apart and positioned about the outer surface of the second rotor between the second rotor and the second cam ring.

18. The method claim 12 further comprising a housing, the first and second cam rings being positioned in the housing.

19. The method of claim 12 further comprising a first pressure plate positioned between the first rotor and the housing and further comprising a second pressure plate positioned between the second rotor and the housing.

* * * * *